US012104511B2

(12) United States Patent
Baeder et al.

(10) Patent No.: US 12,104,511 B2
(45) Date of Patent: Oct. 1, 2024

(54) METHOD FOR CALCULATING REACTION HEAT IN AN EXHAUST SYSTEM

(71) Applicant: Robert Bosch GmbH, Stuttgart (DE)

(72) Inventors: Elke Baeder, Stuttgart (DE); Sascha Giese, Ludwigsburg (DE); Thomas Zein, Sindelfingen (DE); Michael Stein, Loechgau (DE); Patrick Thierfelder, Leonberg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 18/390,102

(22) Filed: Dec. 20, 2023

(65) Prior Publication Data

US 2024/0209767 A1 Jun. 27, 2024

(30) Foreign Application Priority Data

Dec. 23, 2022 (DE) ..... 10 2022 214 359.0

(51) Int. Cl.
*F01N 11/00* (2006.01)
*F01N 3/20* (2006.01)
*F01N 9/00* (2006.01)

(52) U.S. Cl.
CPC ..... *F01N 11/005* (2013.01); *F01N 3/20* (2013.01); *F01N 9/005* (2013.01); *F01N 2900/0412* (2013.01); *F01N 2900/0414* (2013.01); *F01N 2900/0601* (2013.01); *F01N 2900/10* (2013.01); *F01N 2900/1402* (2013.01); *F01N 2900/1411* (2013.01); *F01N 2900/1621* (2013.01); *F01N 2900/1624* (2013.01); *F01N 2900/1631* (2013.01)

(58) Field of Classification Search
CPC ..... F01N 3/20; F01N 9/005; F01N 11/005; F01N 2900/0412; F01N 2900/0414; F01N 2900/0601; F01N 2900/10; F01N 2900/1402; F01N 2900/1411; F01N 2900/1621; F01N 2900/1624; F01N 2900/1631
USPC ..... 60/274, 276, 277, 285, 299
See application file for complete search history.

(56) References Cited

U.S. PATENT DOCUMENTS

2005/0039446 A1* 2/2005 Majima ..... F01N 13/0097 60/284
2012/0047875 A1* 3/2012 Hamama ..... F01N 13/009 60/274
2015/0275792 A1* 10/2015 Genslak ..... F02D 41/1444 60/285
2016/0146135 A1* 5/2016 Goodall ..... F02D 41/1446 701/103

* cited by examiner

*Primary Examiner* — Jorge L Leon, Jr.
(74) *Attorney, Agent, or Firm* — Michael Best & Friedrich LLP

(57) ABSTRACT

A method for calculating reaction heat in an exhaust system of an internal combustion engine by means of a model, comprising a first model component and a second model component, wherein the first model component refers to a calculation of exhaust components flowing from valves of the internal combustion engine, the second model component relates to the entire exhaust system, and total masses from the first model component are divided along the exhaust system onto the individual components of the exhaust system.

8 Claims, 5 Drawing Sheets

METHOD FOR CALCULATING REACTION HEAT IN AN EXHAUST SYSTEM

BACKGROUND

The invention relates to a method for calculating reaction heat for modeling at least one exhaust temperature in an exhaust system, in particular an exhaust system in a motor vehicle, and to an arrangement for performing the method.

An exhaust system is used to gather the exhaust gases flowing from the cylinders and to clean pollutants from said gases. Furthermore, the exhaust system serves to reduce exhaust noises and direct exhaust gases outward from the interior of the vehicle. An exhaust system typically comprises a front system having an exhaust manifold, a cleaning system comprising, for example, particulate filters and at least one catalytic converter, connecting pipes, and a rear system having a muffler system and pipes.

Gas and material temperature calculations at any arbitrary location in the exhaust system of gasoline internal combustion engines in engine control unit software are regularly performed incrementally in the flow direction along the exhaust system. In so doing, the temperatures in the individual components, such as manifold, turbocharger, pipe section, and catalytic converter, are each calculated based on the temperature of the preceding element and the reaction heat arising in the element.

SUMMARY

In light of this, a method and an arrangement are presented. Furthermore, a computer program as well as a machine-readable storage medium are presented. Embodiments arise from the dependent claims and from the description.

It has been found that to accurately model exhaust temperatures, a very accurate calculation of the reaction heat occurring in the exhaust system is needed. To this end, characteristic maps are plotted against load and engine speed, in which the quasi-stationary temperature increase relative to the preceding exhaust element due to catalytic reaction can be defined for the adjacent operating point. This model provides very good results for steady-state operating points, but start-stop operation or overrun cut-off are not sufficiently considered, for example.

The method presented is based on the insight that in dynamic operating conditions, additional heat arises in the catalysts due to exothermic oxygen storage and withdrawal processes. Conditions such as push pumps, i.e., short acceleration phases with push phases at different frequencies, lead to an actual temperature increase in the catalysts, which may be so high that the coatings in a catalytic converter are thermally damaged.

Particularly during an overrun shut-off and for start-stop phases, the storage reaction dominates the heat generation in the catalyst. It has been found that no additional maps are available to the existing model to replicate this additional heat generation. Because stored oil gases also react at the start of lean phases, the quasi-stationary temperature increases are not exclusively dependent on the current operating point, but also on their history, and therefore sometimes differ significantly. This is due to the fact that, depending on the previous operation of the engine, for example in the component protection range with a rich mixture, different amounts of oil gas are stored in the catalytic converter for reacting. Like the storage and withdrawal operations of oxygen, the storage state of oil gas is also not considered by the existing model.

The method is further based on the recognition that said temperature increase under dynamic operating conditions cannot be modeled or can only be insufficiently modeled with the previous model approach. The catalytic converters installed in the exhaust system can therefore only be reliably protected from thermal damage by component protection measures that are used very early or very severely. These measures increase $CO_2$ emissions and should therefore be avoided.

In addition to the dynamic operating states, such as push pumps, the modeling of medium length, i.e., 10 to 30 s, and long phases of overrun shut-off of more than 30 s via a time filter in the existing model also present a challenge, as the storage state of the catalyst surface due to different past operating conditions is not considered. With the previous model approach, the temperature is not always sufficiently modeled. However, accurate modeling and reporting of the temperature in the catalytic converters is of high importance in order to protect them from cooling and to trigger measures for keeping the catalyst hot or cold-start catalyst heating more appropriately for the demand and with greater $CO_2$ efficiency.

In order to be able to operate the catalytic converter as quickly as possible after lean operating points in the optimal, in particular stoichiometric, operating window, the previously stored oxygen is reacted by rich combustion. This is referred to as catalyst cleanup. Here too, a reaction heat arises, which depends not only on the operating point but also on the amount of stored oxygen. The accuracy of the existing model for determining the amount of heat released is also very inaccurate at these operating points and does not account for the storage state of the catalyst surface.

The model deviations resulting from the aforementioned points are particularly noticeable in a typical city trip. This is characterized by low loads, engine speeds, and mass flow rates, as well as frequent short phases of overrun shut-off and start-stop followed by catalyst cleanup. It is possible that model deviations of more than 100 K will occur. Because the temperature range is rather low in these driving situations, there is a risk that catalyst heating measures may be unnecessarily activated, or in the worst-case scenario, will not be activated even when necessary. Both cases negatively impact the emissions produced. In addition, these model deviations reduce the accuracy of catalytic converter diagnostics.

The method presented is for calculating the arising reaction heat to calculate at least one temperature in an exhaust system of an internal combustion engine using a model comprising a first model component and a second model component. The first model component refers to a calculation of exhaust components flowing from valves of the internal combustion engine; the second model component refers to the entire exhaust system. Total masses from the first model component are thereby divided along the exhaust system among the individual components of the exhaust system.

The method presented utilizes a new model of oxygen balancing for the catalysts, which manages to substantially increase the accuracy of modeling the exothermic reaction in the catalysts, especially under dynamic operating conditions. Conditions, such as push pumps, that can actually lead to a sharp temperature increase in the catalysts and can even thermally damage the coatings of the catalysts, are modeled and predicted with sufficiently high model quality. The new function therefore has the advantage that both the trigger time and the severity of the countermeasure can be designed in a more need-based manner and thus $CO_2$ can be saved.

In addition, the new modeling approach improves modeling of medium-length phases, i.e., 10 to 30 s, and long phases of overrun shut-off of more than 30 s. Accurate modeling and reporting of the temperature in the catalysts are of high importance in order to ensure that the catalysts are always kept in an optimum temperature window for converting emissions in order to also comply with future exhaust gas regulations, such as EU7.

With the increased accuracy, it is possible to trigger the catalytic maintenance measures or the catalytic heating for cold starts more closely when the catalysts cool off and thus save $CO_2$ in this way.

The advantages of the new model approach are in modeling the incompletely burned rich exhaust constituents, such as hydrocarbons, carbon monoxide, soot, and lean exhaust constituents, such as oxygen, nitrogen oxides, the combustion specific to an engine cylinder, as well as their storage and/or transport in the gas volumes of the individual exhaust components, as well as the storage and withdrawal into the surface of the catalysts. In the second step, the total heat generated is calculated from the stored oxygen mass and the rich and lean exhaust constituents reacting with each other. This is provided to the exhaust temperature model, which calculates the temperature change for the respective exhaust element or catalyst.

Due to the modeling of the storage capacity of the catalyst surface for rich and lean components, a link between the operating history and the reaction heat currently being released is established for the first time.

Previously, catalytic converter cleanup, overrun shut-off, and other dynamic operating conditions and their catalytic response have been described by individual delta temperatures. In contrast, in the new physical modeling approach, only the storage of exhaust components and their reaction with each other are considered. Thus, the modeling of the exothermic reaction in the catalysts for stationary and, above all, under dynamic operating conditions, is carried out in a much more precise, physical, and reliable manner. This is closer to the real-world process. Instead of writing a 10 K increase in temperature in a map, an amount of heat resulting in a 10 K increase in temperature is calculated from a defined mass of oxygen and oil gas along with an associated reaction enthalpy. Instead of adding 10 K, as in the empirical model variant, the physics and chemistry behind the effect, the temperature increase, are depicted.

The described arrangement is used to carry out the presented method and is implemented in hardware and/or software, for example. The arrangement may also be integrated in a control unit of a motor vehicle or configured as such.

Further advantages and configurations of the invention arise from the description and the accompanying drawings.

It goes without saying that the aforementioned features and the features yet to be explained below can be used not only in the particular specified combination, but also in other combinations or on their own, without leaving the scope of the present invention.

DETAILED DESCRIPTION

Figure 1:
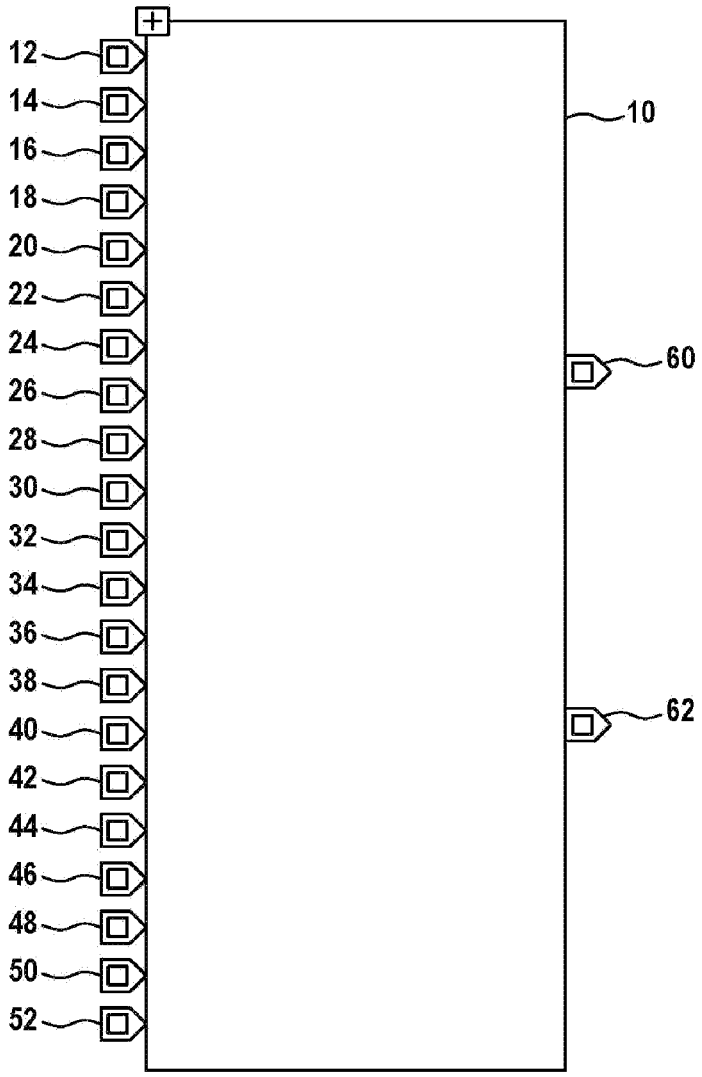
FIG. 1 shows input and output variables of a first model component in a block diagram.

The invention is illustrated schematically in the drawings on the basis of embodiments and is described in detail below with reference to the drawings.

FIG. 1 shows input and output variables of a first model component, altogether designated with the reference numeral 10. Input variables are:

- cylinder assignment to exhaust bank (reference numeral 12),
- relative air charge in the cylinder (reference numeral 14),
- request cold engine catalyst heating (reference numeral (16),
- request catalyst heating to keep catalyst warm (reference numeral 18),
- request catalyst heating for desulfurization of the main catalyst (reference numeral 20),
- status of operating mode HSP (homogenous-split) is set (reference numeral 22),
- EPM (Engine Position Management) software cylinder counter (reference numeral 24),
- engine speed (reference numeral 26),
- selecting the engine speed (reference 28),
- average efficiency depending on the ignition angle bank 1 (reference numeral 30),
- stoichiometric air-fuel ratio (reference numeral 32),
- cylinder-specific mixture factor (reference numeral 34)
- cylinder-specific array of relative fuel mass (reference numeral 36),
- cylinder-specific Atkinson fuel mass (reference numeral 38),
- total injection masking pattern (reference numeral 40),
- oxygen target value in combustion chamber (reference numeral 42),
- mass flow from intake pipe in manifold during valve overlap (reference numeral 44),
- total relative filling without internal residual gas (reference numeral 46),
- relative fuel fraction of outgassing fuel from engine oil (reference numeral 48),
- relative mixture fraction for tank venting (reference numeral 50),
- charge conversion factor in mass flow (reference numeral 52).

Figure 2:
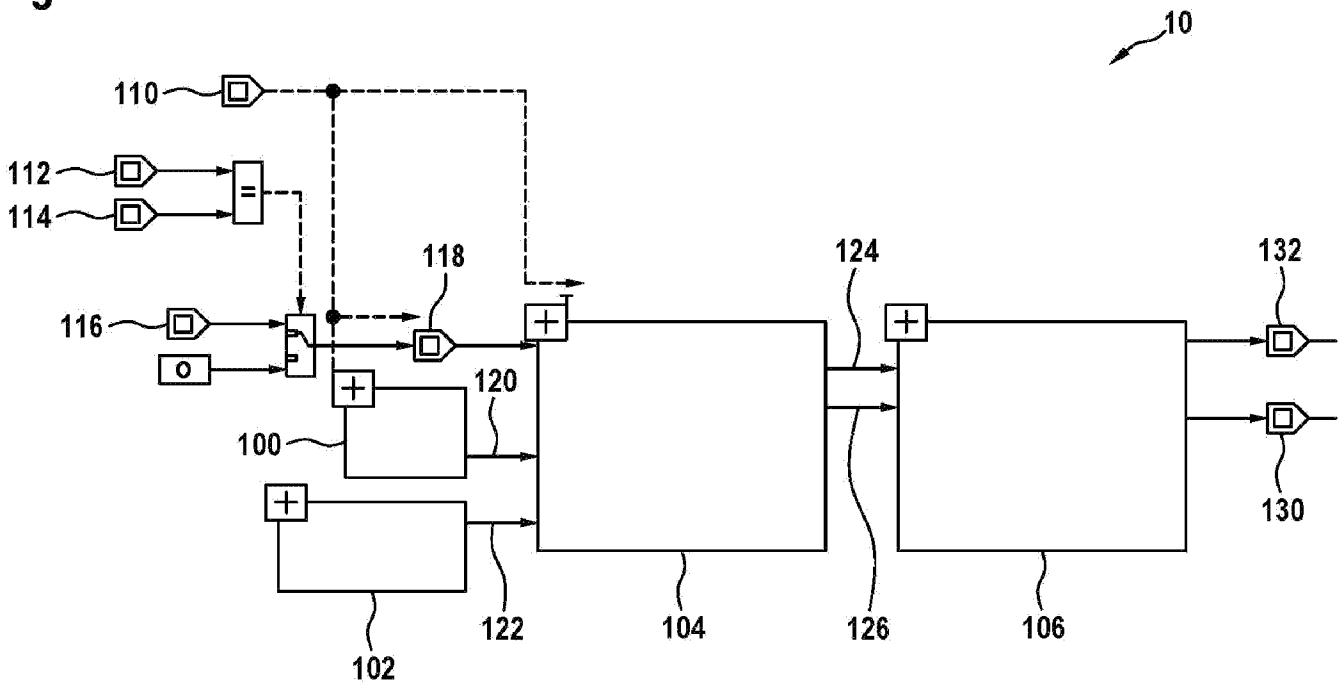
FIG. 2 shows the first model component in a block diagram.

Output variables are control unit signals:

- fuel equivalent oxygen mass flow at exhaust valve bank 1 (reference numeral 60),
- oxygen mass flow at exhaust valve bank 1 (reference numeral 62), FIG. 2 shows a flow chart of the first model component 10 in a block diagram. The plot shows a first calculation block 100 for a relative fuel charge flowing into engine bank 1, a second calculation block 102 for a combustion effectiveness factor for engine bank 1, a third calculation block 104 for calculating the incompletely reacted air and fuel contents in the engine, and a functional block 106 for calculating the reactive residual gases flowing from the engine into the exhaust system, for example, conversion of mass fuel flow and correction of overflowing fresh air before combustion.

Input variables are:

calculate function command (reference numeral 110), engine speed selection (reference numeral 112), engine speed status=0 (reference numeral 114), total relative charge without internal residual gas (reference numeral 116), relative air charge flowing into engine (without inert gas) bank 1 (reference numeral 118).

Further variables are:

relative fuel charge flowing into engine bank 1 (reference numeral 120), combustion effectiveness factor engine bank 1 (reference numeral 122), the effectiveness refers here to the chemical conversion efficiency of air and fuel, relative air charge after combustion (accumulated since the last calculation of the function) bank 1 (reference numeral 124), air or air lean gas components not fully reacted here after combustion, relative fuel charge after combustion (accumulated since the last calculation of the function) bank 1 (reference numeral 126), fuel or oil gas components not fully reacted here after combustion.

Output variables are:

fuel equivalent oxygen mass flow at exhaust valve bank 1 (reference numeral 130), oxygen mass flow at exhaust valve bank 1 (reference numeral 132).

Figure 3:
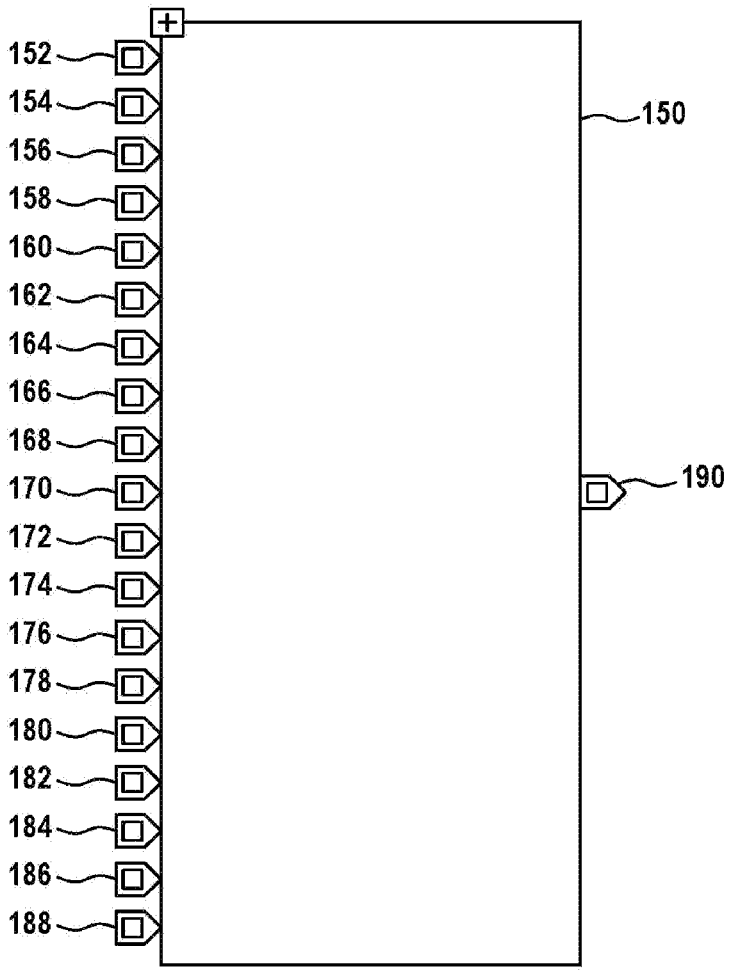
FIG. 3 shows input and output variables of a second model component in a block diagram.

FIG. 3 shows input and output variables of a second model component, altogether designated with the reference numeral 150. Input variables are:

exhaust temperature array (reference numeral 152), exhaust mass flow array (reference numeral 154), index of the first brick catalyst (reference numeral (156), index of the last brick catalyst (reference numeral (158), turbo index position (reference numeral 160), y-split index position (reference numeral 162), calculated oxygen storage capacity, catalyst 1 (reference numeral 164), calculated oxygen storage capacity, catalyst 2 (reference numeral 166), calculated oxygen storage capacity, catalyst 3 (reference numeral 168), oxygen storage capacity of a new catalyst 1 (reference numeral 170), oxygen storage capacity of a new catalyst 2 (reference numeral 172), oxygen storage capacity of a new catalyst 3 (reference numeral 174), fuel equivalent oxygen mass flow at exhaust valve bank 1 (reference numeral 176), oxygen mass flow at exhaust valve bank 1 (reference numeral 178), number of brick catalysts (reference numeral 180), exhaust pressure array (reference numeral 182), exhaust lambda upstream of the catalysts (reference numeral 184), aging factor catalyst array, bank 1 (reference numeral 186), stoichiometric air-fuel ratio (reference numeral 188), Output variable is a control unit signal:

reaction heat in the elements of the exhaust system, bank 1 (reference numeral 190).

Figure 4:
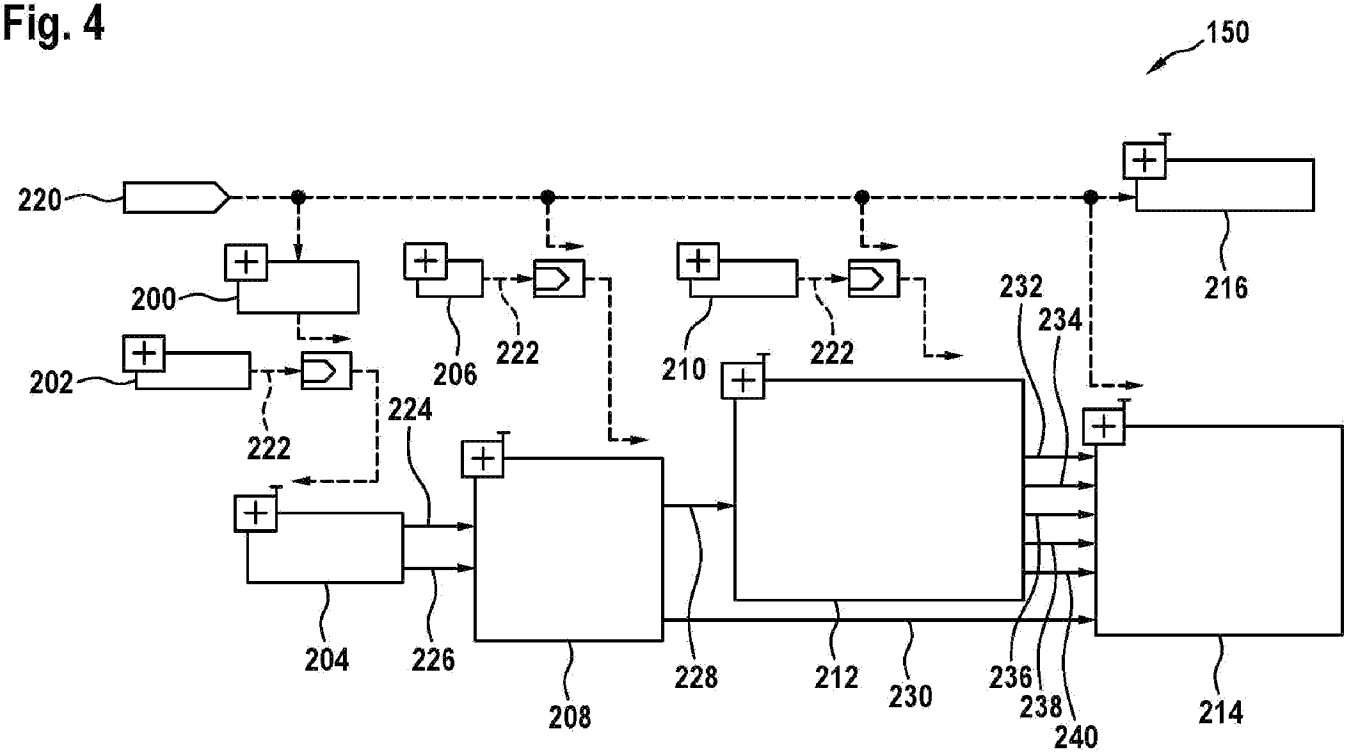
FIG. 4 shows the second model component in a block diagram.

FIG. 4 shows a flow chart of the second model component 150 in a block diagram. The illustration shows a first functional block 200 for element properties where various properties of the currently calculated exhaust system element are assigned; a second functional block 202 for determining that there is no dummy behavior; the exhaust system is replicated in the exhaust temperature model in the so-called structure vector, empty spaces therein are filled in with dummy elements; if the element to be calculated is a dummy then the function is not calculated. The illustration further shows a third functional block 204 for calculating lean and oil gas mass in the gas of the current element; a fourth functional block for determining whether the current element is a brick catalyst; a fifth functional block 208 for calculating lean and oil gas mass stored in the catalyst surface, upon storage of lean gas in the catalyst surface, a reaction heat is released, which is also calculated here; a sixth functional block 210 for determining whether oil and lean gases can react in the current element; a seventh functional block 212 for calculating the reaction of the oil and lean gases and the resulting reaction heat; an eighth functional block 214, which is an interface for providing the output variables; and a ninth functional block 216 for incrementing the element counters.

Variables are:

calculation commands 1 to 7 (reference numeral 220), the sequence of calculation, software class elemental properties in blocks 202, 206, 210 (reference numeral 222).

lean gas mass in the gas of the current element (reference numeral 224), oil gas mass (oxygen equivalent) in the gas of the current element (reference numeral 226), data structure in which information on the catalyst surface is present (reference numeral 228), for example, oil and lean gas mass currently stored in the surface, reaction heat due to storage of lean gas in the catalyst surface (reference numeral 230), lean gas mass in the gas of the current element after reaction (reference numeral 232), lean gas mass in the surface of the current element (if a catalyst) after reaction (reference numeral 234), oil gas mass in the gas of the current element after reaction (reference numeral 236), oil gas mass in the surface of the current element (if a catalyst) after reaction (reference numeral 238), reaction heat due to reaction of oil and lean gases (reference numeral 240)

The model is thus divided into two model components 10, 150 and areas. The first area relates to the calculation of exhaust components flowing out of the valves of the engine. Here, the incompletely reacted exhaust components, as well as the air flowing directly into the exhaust system, are calculated individually for each cylinder. The amount of air, the mixture, and the ignition timing must be observed. By cylinder-specific calculation from the current engine operating variables, special modes of operation, such as overrun shut-off, cylinder suppression, half-engine operation, scavenging, and purging and cylinder balance, are automatically covered.

Output from the first model range is the sum of the mass flows of the reactive residual gas components across all cylinders of an exhaust bank.

The second area refers to the entire exhaust system. Here, the total masses from the first model part are distributed along the exhaust system to the individual components, such as manifold, turbocharger, catalytic converter, particulate filter. In catalysts and catalytically coated particulate filters, storage of a portion of the residual gases into the catalyst surface is also modeled depending on an applied adsorption efficiency.

Because the catalytic surfaces have limited storage capacity, the storage capability values of the individual catalysts are read from the catalytic converter diagnostic functions; alternatively, a fixed value may be specified. The heat generated by the exothermic reaction of storing oxygen in the catalytic surfaces is calculated.

Depending on the amount of rich and lean portions present in the gas volume and on the surface, the reaction heat is modeled by the reaction of rich and lean exhaust components to carbon dioxide and water depending on an applied reaction efficiency. Unreacted portions from the surface are considered again in the next calculation step. Components remaining in the gas are passed to the subsequent exhaust element.

Finally, the proportions of heat generated from the adsorption and reaction per exhaust element are added and used to calculate the modeled exhaust temperature in that exhaust element.

Figure 5:
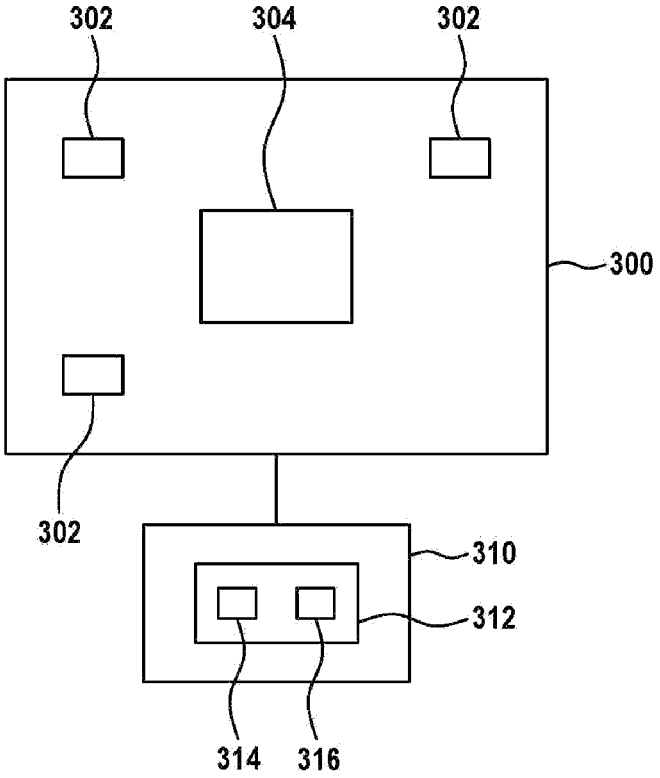
FIG. 5 purely schematically shows an exhaust system having an arrangement for performing the method.

In FIG. 5, a simplified exhaust system is shown altogether with reference numeral 300. A number of components 302 and a catalyst 304 are provided therein. The catalytic converter 304 also represents a component of the exhaust system 300. The exhaust system 300 is associated with an arrangement 310 for performing the method. In this arrangement 310, a model 312 having a first model component 314 and a second model component 316 is provided.

The invention claimed is:

1. A method for calculating reaction heat in an exhaust system (300) of an internal combustion engine using a computer configured with a model (312) including a first model component (10, 314) and a second model component (150, 316), the method comprising:

calculating, using the first model component (10, 314), an exhaust gas composition based on current engine operational variables, dividing, using the second model component (150, 316), total gas masses from the first model component (10, 314) among individual components (302) of the exhaust system (300) so as to calculate a reaction heat in each component (302) of the exhaust system (300), and controlling an amount of heat provided to at least one component (302) of the exhaust system (300) based on the calculated reaction heat.

2. The method according to claim 1, wherein the calculating of the exhaust gas composition includes calculating, for each cylinder of the engine, an amount of incompletely combusted exhaust gas elements and air flowing directly into the exhaust system (300).

3. The method according to claim 2, wherein the current engine operational variables include at least one auxiliary mode of operation.

4. The method according to claim 3, wherein the at least one auxiliary mode of operation is selected from a group consisting of: overrun shut-off, cylinder suppression, half-engine operation, purging, and cylinder balance.

5. The method according to claim 1, wherein the dividing is carried out in the second model component (150, 316) depending on a gas mass flow rate and a gas volume of the individual components (302) of the exhaust system (300).

6. The method according to claim 1 wherein, in the second model component (150, 316), a storage of a portion of residual gases into a catalyst surface is modeled based on an applied adsorption efficiency.

7. An assembly for calculating reaction heat in an exhaust system (300) configured to perform the method according to claim 1.

8. A non-transitory, computer-readable medium containing instructions that when executed by a computer cause the computer to perform a set of operations comprising:

calculating, using a first model component (10, 314) of a model (312), an exhaust gas composition of an internal combustion engine, dividing, using a second model component (150, 316) of the model (312), total gas masses from the first model component (10, 314) among individual components (302) of an exhaust system (300) of the engine, calculating, using the second model component (150, 316), reaction heat in each component (302) of the exhaust system (300), and controlling an amount of heat provided to at least one component (302) of the exhaust system (300) based on the calculated reaction heat.

* * * * *